US005263473A

United States Patent [19]

McWhorter

[11] Patent Number: 5,263,473

[45] Date of Patent: Nov. 23, 1993

[54] COMPRESSION DEVICE FOR THE LIMB

[75] Inventor: Daniel M. McWhorter, Hopkinton, Mass.

[73] Assignee: The Kendall Company, Mansfield, Mass.

[21] Appl. No.: 821,162

[22] Filed: Jan. 14, 1992

Related U.S. Application Data

[63] Continuation of Ser. No. 608,954, Nov. 5, 1990, abandoned.

[51] Int. Cl.[5] ..... A61H 1/02; A61H 7/00

[52] U.S. Cl. ..... 128/25 R; 128/64

[58] Field of Search ..... 128/87 R, 64, 38, 24 R, 128/DIG. 20, 24.1, 24.2, 24.3, 24.4, 25 R; 272/86; 137/542

[56] References Cited

U.S. PATENT DOCUMENTS

| | | | |
|---|---|---|---|
| 4,013,069 | 3/1977 | Hasty | 128/64 |
| 4,370,975 | 2/1983 | Wright | 128/64 |
| 4,374,518 | 2/1983 | Villanueva | 128/64 |
| 4,402,312 | 9/1983 | Villari | 128/64 |
| 4,841,956 | 6/1989 | Gardner | 128/64 |
| 4,941,458 | 7/1990 | Taheri | 128/64 |
| 4,989,589 | 2/1991 | Pekanmäki | 128/64 |
| 5,007,411 | 4/1991 | Dye | 128/64 |
| 5,022,387 | 6/1991 | Hasty | 128/64 |
| 5,052,377 | 10/1991 | Frajdenrajch | 128/64 |

*Primary Examiner*—Robert A. Hafer
*Assistant Examiner*—Michael Brown
*Attorney, Agent, or Firm*—Alvin Isaacs

[57] ABSTRACT

Disclosed is a compression device and method for applying compressive pressure against a patient's limb in periodic compression cycles, wherein an elongated sleeve having a plurality of inflatable chambers is placed over the foot and a portion of the leg, the chambers being sequentially inflated starting with the foot and then form a distal portion of the leg toward a proximal portion of the leg relative to the heart until all of the chambers are inflated.

9 Claims, 1 Drawing Sheet

COMPRESSION DEVICE FOR THE LIMB

This is a continuation of application Ser. No. 07/608,954, filed on Nov. 5, 1990, now abandoned.

BACKGROUND OF THE INVENTION

Prior to the present invention, various compression devices have been known in the art for applying compressive pressure to a patient's limbs in order to increase blood flow velocity. Particularly useful are the SCD (trademark of The Kendall Company, assignee of the present invention) sequential compression devices providing intermittent pulses of compressed air which sequentially inflate multiple chambers in a sleeve, beginning at the ankle and moving up the leg. This results in a wave-like milking action which empties the veins and results in greatly increased peak blood flow velocity, thus providing a non-invasive method of prophylaxis to reduce the incidence of deep vein thrombosis (DVT). These compression devices find particular use during surgery on patients with high risk conditions such as obesity, advanced age, malignancy, or prior thromboembolism. When a DVT occurs, the valves that are located within the veins of the leg can be damaged, which in turn can cause stasis and high pressure in the veins of the lower leg. Patients who have this condition often have swelling (edema) and tissue breakdown (venous stasis ulcer) in the lower leg. It has also been shown that pneumatic compression can be highly effective in the treatment of such edema and venous ulcers. This treatment is usually performed at home on a daily basis.

Devices of the foregoing description are disclosed in various patents of which the following are illustrative: U.S. Pat. Nos. 4,013,069 and 4,030,488 issued to James H. Hasty; 4,320,746 issued to Edward J. Arkans and Frank K. Villari; and 4,938,208 issued to John F. Dye, the last-mentioned patent to John F. Dye being particularly directed to units for home treatment.

In general, the compression devices of the prior art comprise a sleeve having a plurality of separate fluid pressure chambers progressively arranged longitudinally along the sleeve from a lower portion of the limb to an upper portion. Means are provided for intermittently forming a pressure pulse within these chambers from a source of pressurized fluid during periodic compression cycles. Preferably, the sleeve provides a compressive pressure gradient against the patient's limb during these compression cycles which progressively decreases from the lower portion of the limb, e.g. from the ankle to the thigh.

Sequential pneumatic compression devices of the foregoing description applying compression to the lower limb have achieved considerable notoriety and wide acceptance as an effective non-invasive means for preventing deep vein thrombosis and for treating venous stasis ulcers.

They function by applying pneumatic compression sequentially and in gradient levels from ankle to thigh for a predetermined time, e.g. 15 seconds, followed by a period of time, e.g. 45 seconds, when no pressure is applied. The particular time period selected is chosen to be optimum for pushing venous blood out of the leg (during the compression cycle) and to allow arterial blood to refill the leg (during the decompression interval).

It has recently been discovered that it may also be advantageous to apply pneumatic compression to the foot to provide significant venous blood movement therefrom. For example, U.S. Pat. Nos. 4,702,232 and a division thereof, 4,841,956, of Arthur M. N. Gardner and Roger H. Fox relate to a device for inducing venous-return flow, which device is intended for use on an impaired human leg. In accordance with the teachings of these patents, the cyclical succession of venous pump action which would occur in normal walking is achieved by involuntarily or artificially activating a foot pump followed by artificially induced separate transient operation of a proximal calf pump and then an artificially induced separate operation of a distal calf pump. As disclosed, the pump actions are achieved by providing inflatable bags or cuffs around the foot and upper and lower calf regions, the inflatable cuffs being separately connected by tubes to a fluid pressure supply means. Each cuff is inflated and then deflated before the next cuff is inflated. Moreover, the cuffs are not inflated sequentially from distal to proximal, e.g. the sequence disclosed in the patent of foot pump, proximal calf pump and then distal calf pump which procedure does not encourage an effective pumping of blood from the leg.

In contrast thereto, the task of the present invention, stated simply, is to provide an improved compression device which provides more complete venous emptying by applying compression to the plantar venous plexus in the foot as well as sequentially to the leg, thereby more effectively obviating the trapping of blood which can occur in the foot veins, particularly during initial compression, as may be the case with the current sequential compression devices applying no sequential compression to the foot region.

BRIEF DESCRIPTION OF THE INVENTION

In accordance with the present invention, this task is satisfied in an elegant means by providing a sequential compression device comprising an elongated sleeve having a plurality of inflatable chambers for placement over the foot and a portion of leg, a means for sequentially inflating said chambers in an order with the foot chamber being inflated first and the remaining chambers of the leg subsequently in an arrangement from a distal portion of the leg towards a proximal portion of the leg relative to the heart.

A feature of the present invention is that the chambers of the leg are inflated while the foot chamber remains inflated.

Another feature of the invention is that the foot chamber propels blood from the foot towards the leg for compression by the inflated leg chambers, thereby enhancing the movement of blood.

Yet another feature of the invention is that the chambers may be intermittently deflated.

A further feature of the invention is that the inflating means can maintain a baseline pressure in the chambers at all times over which periodic compression cycles occur.

Yet another feature of the invention is that the inflating means controls the maximum pressure in the chambers such that at least some of said pressure is decreased toward the proximal portion of the leg.

A further feature of the invention is that in the preferred embodiment, the portion of the sleeve defining the foot chamber is a one-piece construction with a portion defining the chambers of the leg.

The feature of the invention is that the sleeve is a simplified construction and used for compression of the foot and leg of the limb.

Yet another feature of the invention is that the device inflates the sleeve such that the trapping of blood in the limb is minimized.

Yet another feature of the invention is that the device inflates the sleeve such that the improvement of blood flow through the limb is maximized while trapping of fluid is minimized.

A further feature of the invention is that dynamic control may be maintained over the chambers during inflation to maintain the chambers inflated in desired pattern.

Further features will become more fully apparent in the following detailed description of the invention in conjunction with the illustrative drawing and the appended claims.

DESCRIPTION OF PREFERRED EMBODIMENTS

Figure 1:
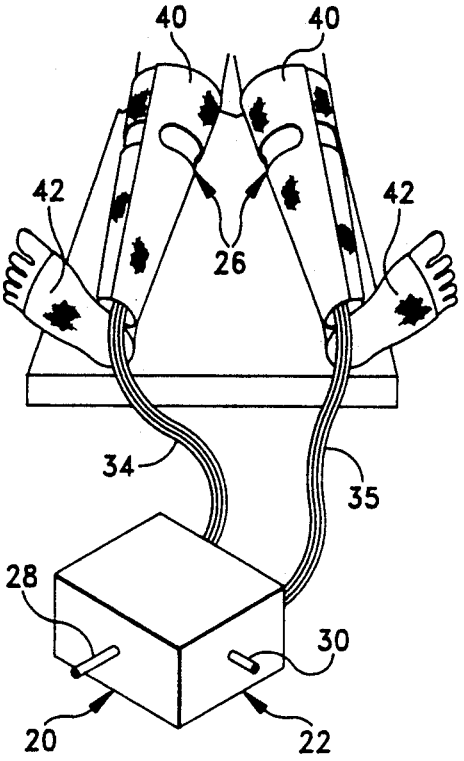
FIG. 1 is a perspective view of a compression device of the present invention.

Referring now to FIG. 1, there is shown a device generally designated 20 for compressing a patient's limb, such as the leg, as shown. The compression device 20 has a controller generally designated 22 and a pair of elongated sleeves 26 for covering the patient's limbs. The controller 22, which per se comprises no part of this invention, may be of the type disclosed, for example, in U.S. Pat. Nos. 4,013,069 and 4,030,488, incorporated herein by reference, and the controller 22 sequentially passes fluid through a pair of conduits 34 and 35 to the sleeves 26 in order to inflate chambers in the sleeves, as will be discussed below, from a source of fluid through a conduit 28 communicating with the controller 22, and the controller 22 may intermittently connect the inflated chambers of the sleeves 26 to an exhaust or conduit 30.

Figure 2:
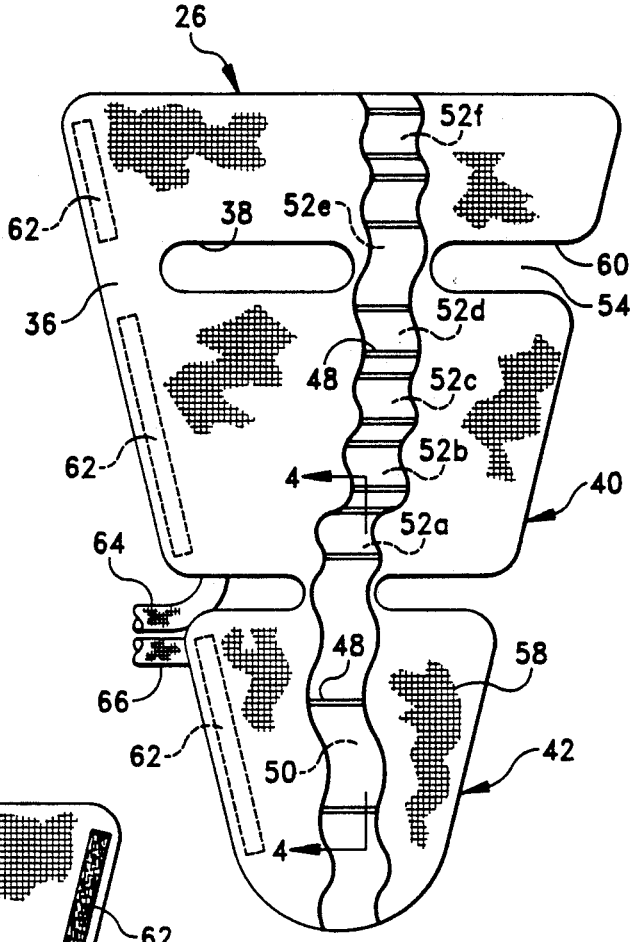
FIG. 2 is a front plan view, partly broken away, of a sleeve for the device of FIG. 1.
Figure 3:
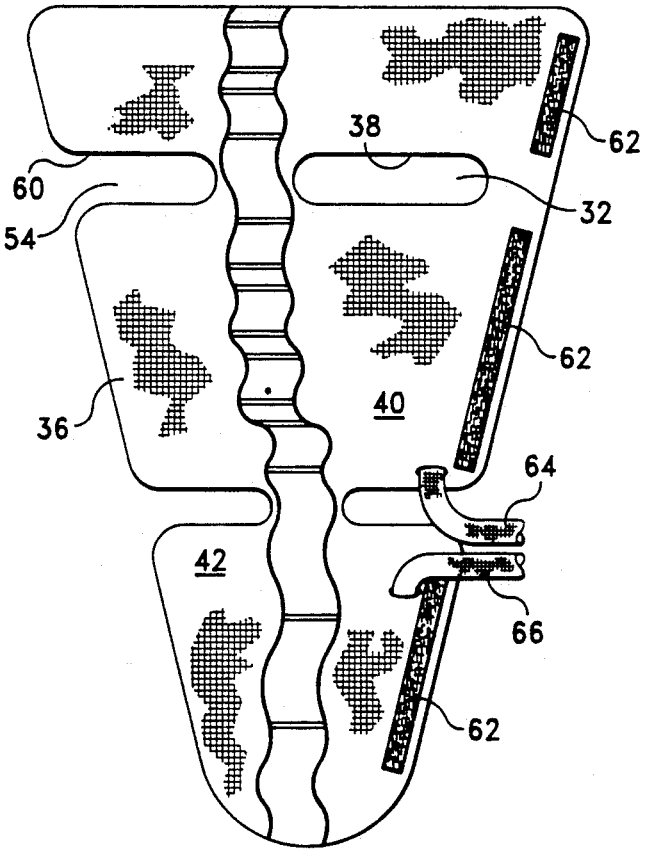
FIG. 3 is a plan view of the backside of the sleeve of FIG. 2.
Figure 4:
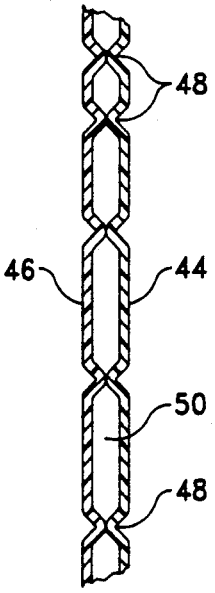
FIG. 4 is a fragmentary sectional view of an inner portion of sleeve of FIG. 2.

With reference to FIGS. 2–4, the sleeves 26 have a leg portion 40 for covering the leg from the region of the ankle to the thigh, and a foot portion 42 for covering the foot of a patient. The sleeves 26 have a pair of inner fluid impervious sheets 44 and 46 which are joined together along lines 48 by suitable means, such as by heat sealing in order to form chambers in the sleeves 26. Thus, the foot portion 42 has a laterally extending chamber 50 at a location for covering the plantar arch intermediate the ball and the heel of the foot at a location underneath the foot, although the foot chamber 50 may extend partially or entirely around the upper portion of the foot after placement of the sleeve 26, if desired. As shown, the leg portion 40 of the sleeve 26 has a plurality of progressively located chambers 52*a*, 52*b*, 52*c*, 52*d*, 52*e*, and 52*f* extending laterally in the sleeve 26 such that they are raised to cover the ankle, calf and thigh of the leg at a location extending from the ankle to the thigh region of the leg. In a preferred form, the leg chamber 52*a–f* extend completely around the limb after placement of the sleeve 26. As shown, in a preferred form, the foot portion 42 is of 1-piece construction with a leg portion 40 and sleeve 26 to provide sleeve 26 of simplified construction and reduce cost. The conduits 34 and respective foot chambers 50 and the leg chambers 52*a–f* in a suitable manner (not shown), such as by the connectors disclosed in U.S. Pat. No. 4,320,746, incorporated herein by reference.

If desired, the sleeves 26 may have an inner sheet of suitable flexible material (not shown) covering an inner surface of the sheets 44 and 46 to provide comfort to the limb during the use of the device 20 after placement of the sleeve 26, and may have an outer sheet 58 of a loop material, such as a knit fabric covering an outer surface of the sheets 44 and 46. The sleeves 26 may have elongated strips 62 of a hook material extending along a side of the foot portion 42 and leg portion 40 of the sleeve 26 for a purpose which will be described below. The conduits 34 and 35 may be covered with a suitable tube 64 for the leg portion 40 of the sleeve 26 and the tube 66 of fabric for the foot portion 42 in a manner as disclosed in U.S. Pat. No. 4,320,746, incorporated herein by reference.

While not necessary to the practice of this invention, as in prior compression devices of the general description, sleeve 26 may have an elongated opening 32 extending through a knee region 36 of the sleeve, defined by peripheral edges 38 around the opening 32. In addition, as shown, the sleeve 26 may have an elongated opening or cut-out 54 in the knee region 36 extending from one side edge toward a lateral central portion of the sleeve, with the cut-out 54 being defined by peripheral edges 60. As is described with more particularity in U.S. Pat. No. 4,207,875 issued to Edward J. Arkans, the purpose of these openings is to enhance the flexibility of the sleeve in the knee region.

Preparatory to use, the sleeves 26 are placed over the limbs of the patient, with the foot portion 42 located over the patient's foot, and the leg portion 40 over the patient's leg. The sleeves 26 are wrapped about the foot and leg, such that the foot portion 42 of the sleeve 26 encompasses the foot, and the leg portion 40 of the sleeve 26 encompasses the leg. In this configuration, the strips 62 of the sleeve 26 may be placed in contact with the outer loop sheet 58 in order to engage the hook strip 62 at an adjustable position on the sheet 58 of loop material in order to secure both the foot portion 42 and leg portion 40 of the sleeve in place in a comfortable and snug position about the patient's limbs.

In use, the controller 22 is operated in order to sequentially inflate the foot chamber 50 and leg chambers 52*a–f*, in an order with the foot chamber being inflated first and the remaining chambers of the leg subsequently in an arrangement from a distal portion of the leg towards a proximal portion of the leg relative to the heart while the foot chamber remains inflated. Thus, the foot chamber 50 is inflated first in order to enhance circulation of blood from the foot into the leg, after which the leg portion 40 of the sleeve is operated in order to sequentially inflate the leg chambers in order with the ankle being inflated first, the calf portion being inflated after the ankle portion, and then the thigh portion being inflated after the calf portion. In this manner, the leg portion 40 of the sleeve 26 enhances the movement or circulation of blood through the legs after the blood from the foot has been circulated into the legs, thereby preventing trapping of blood in the foot, and enhancing blood circulation through the legs in a direction toward the heart. During the sequential inflation of the leg chambers 52*a–f* of the sleeves 26, the foot chamber 42 remains inflated, and, in a preferred form, each of the more distal chambers of the leg portion 40 also remains inflated during subsequent inflation of more proximal chambers of the leg portion 40 of the sleeves 26, such that each of the chambers of the sleeves 26 remain inflated during compression cycles of device 20. In this manner, the device maintains pressures in the respective chambers during periodic compression cycles, after which cycles the chambers are then deflated. Further, a preferred form the controller 22 controls the maximum pressure in each chamber such that at least some of the pressure is decreased toward the proximal portion of the leg.

Thus, according to the present invention, the foot chamber 50 of the foot portion 42 is initially inflated during a compression cycle in order to enhance movement of the blood into the leg of the patient after which the leg chambers 52*a–f* are sequentially inflated in order to propel the blood from the limbs toward the patient's heart. In this manner, the device 20 prevents trapping of fluid in the patient's limb while materially increasing the rate of blood flow through the limb during operation of the device 20. Stated another way, device 20 of the present invention maximizes the movement of fluid while minimizing the trapping of fluid in the limb in an improved manner.

According to the present invention, in a preferred form, the controller sequentially inflates the chambers of the sleeves 26 and retains dynamic control during inflation in order to maintain the chambers inflated in a desired pattern during operation of the device. In this manner, control may be maintained over the inflation pressures in each of the chambers individually during inflation.

It will be appreciated that various changes and additions may be made in the device shown in the illustrative drawing without departing from the scope of the invention herein contemplated.

For example, while the device has been illustrated to be a unitary sleeve 26 having a leg portion 40 and a foot portion 42, it will be apparent that the leg and foot portions may instead be separate sleeves encompassing the respective limb portions where compression is to be applied.

Further, while the preferred compression devices, i.e. the "SCD" device manufactured and sold by The Kendall Company, assignee of the present invention, provide a pressure gradient, it is within the scope of this invention to provide compression patterns which do not. It is also within the scope of this invention to maintain a minimum or base pressure in each of the compression chambers throughout the entire inflation and deflation cycles.

This base pressure may be the same in each of the chambers in the sleeve, e.g. on the order of about 10 mm of mercury or, alternatively, it may be the greatest in the foot chamber and then become progressively lower in each successive chamber. For example, the foot chamber may be on the order of 10 mm; the ankle chamber on the order of 8 mm; the calf on the order of 6 mm; and thigh 4 mm.

As heretofore alluded to, the patent literature is replete with references to sequential compression devices. In general, any of the modifications described and claimed in these prior patents may be incorporated into the novel device of this invention.

For instance, a ventilation chamber may be included, as disclosed in U.S. Pat. Nos. 4,091,804 of James H. Hasty or 4,481,937 of Edward J. Arkans.

Other modifications which may be made included, but are not limited to the following: providing concurrent rather than sequential inflation (compression) from a single pulse to apply a gradient from ankle to thigh, as described in U.S. Pat. No. 4,030,488 of James H. Hasty; providing means for monitoring the pressure in the sleeves, as disclosed in U.S. Pat. No. 4,331,133 of Edward J. Arkans; sensing the pressure in the chambers and then venting to prevent over-pressurizing, as taught in U.S. Pat. No. 4,396,010 of Arkans; and including an arterial thrombosis detection system, as disclosed in U.S. Pat. No. 4,574,812 of Arkans. Other changes and additions will be readily suggested to those skilled in the art in the light of the foregoing description.

While the present invention is primarily directed to preventing deep vein thrombosis which can occur while a patient is bedridden, e.g. following surgery, it also may find utility in inhibiting edema, particularly lymphedema, a chronic unilateral or bilateral edema of the legs due to accumulation of interstitial fluid as a result of stasis of lymph, which is secondary to obstruction of lymph vessels or disorders of the lymph nodes.

It may also be used for the treatment of chronic venous disease, one consequence of which is venous stasis ulceration of the leg.

By way of recapitulation, it will be seen that the present invention provides an improved compression device for the limb in that it permits a more complete venous return or emptying of the leg since it includes compression to the plantar venous plexus.

For this reason, trapping of venous blood in the foot veins during compression is obviated. This advantage distinguishes the present invention over the foot pumps of the prior art such as those described in the aforementioned U.S. Pat. Nos. 4,702,232 and 4,841,956 of Gardner and Fox in that the present invention provides a more complete emptying of the limb veins, particularly at the valve cusp, a locus particularly susceptible to stasis.

The foregoing detailed description is given for clearness of understanding only and no unnecessary limitations should be understood therefrom, as modifications will be obvious to those skilled in the art.

What is claimed is:

1. A compression device for applying compressive pressure against a patient's foot and leg, comprising:

a sleeve having an elongated leg portion for enclosing a length of the patient's leg and a foot portion for covering the patient's foot, the elongated leg portion of the sleeve containing a plurality of separate pressure chambers progressively arranged longitudinally along the leg portion from a lower portion of the leg to an upper portion of the leg proximal the patient's heart relative to the lower portion;

the foot portion having a laterally extending foot chamber for covering the plantar arch of the foot intermediate the ball and heel of the foot at a location under the foot;

means for intermittently forming a pressure pulse from a source of pressurized fluid to provide periodic compression cycles;

means for connecting the foot chamber to the pressure pulse for intermittently inflating the foot chamber to propel blood from the foot towards the leg;

means for separately connecting the pulse to each of the chambers of the leg after the foot chamber is inflated and while the foot chamber remains inflated;

means for developing progressively diminishing rates of pressure increases in progressively located upper chambers during each compression cycle to apply a compressive pressure gradient with the greatest pressure being exerted in the foot chamber, the pressure on the leg progressively decreasing from lower to upper pressure chambers in the leg portion of the sleeve and means for intermittently connecting the chambers to an exhaust means during periodic decompression cycles between the compression cycles, thereby maximizing blood flow from the foot proximally throughout the leg toward the heart while minimizing trapping of blood in the foot.

2. A device as claimed in claim 1 wherein said foot portion if of a 1-piece construction with the leg portion.

3. A device as claimed in claim 1 wherein a minimum or base pressure is maintained in the chambers during the periodic compression and decompression cycles.

4. A device as claimed in claim 3 wherein said base pressure in each chamber is on the order of 10 mm of mercury.

5. The method for increasing blood flow in a patient's limb comprising the steps of:

(1) applying to the patient's limb a device having a foot portion for covering the patient's foot and a leg portion for covering the leg from the ankle region to the thigh region of the limb, the foot portion having a laterally extending inflatable chamber covering the plantar arch intermediate the ball and heel of the foot at a location under the foot, the leg portion having a plurality of progressively located inflatable chambers extending upwardly on the leg to cover the ankle, calf and thigh regions of the leg;

(2) inflating the foot chamber in order to apply compressive pressure to the foot to enhance movement of the blood into the leg of the patient;

(3) thereafter, and while maintaining the compressive pressure on the foot, sequentially inflating the chambers in the leg portion proximally from the ankle region whereby to propel the blood from the leg toward the patient's heart, thereby inhibiting trapping of blood in the limb while materially increasing the rate of blood flow; and (4) defining the chamber to release the compressive pressure to the foot and leg.

6. The method as defined in claim 5 wherein a gradation of pressure is provided with the greatest pressure being applied to the foot chamber and decreasing sequentially from the foot proximally up the leg toward the heart.

7. The method as defined in claim 5 wherein the steps of inflating and deflating the chambers are repeated through a plurality of compression cycles.

8. The method as defined in claim 7 wherein a base pressure is maintained in the chambers during the compression cycles.

9. The method as defined in claim 8 wherein the base pressure is the same in each chamber and is on the order of about 10 mm of mercury.

* * * * *